US005617924A

United States Patent [19]

Baron et al.

[11] Patent Number: 5,617,924

[45] Date of Patent: Apr. 8, 1997

[54] ARRANGEMENT FOR TIGHTENING SCREW CONNECTIONS

[75] Inventors: Wolfgang Baron, Backnang; Erich Nold, Stuttgart, both of Germany

[73] Assignee: Robert Bosch GmbH, Stuttgart, Germany

[21] Appl. No.: 277,961

[22] Filed: Jul. 20, 1994

[30] Foreign Application Priority Data

Aug. 18, 1993 [DE] Germany ..... 9312303 U

[51] Int. Cl.[6] ..... B25B 21/00

[52] U.S. Cl. ..... 173/181; 173/222

[58] Field of Search ..... 173/176, 222, 173/179, 180, 181, 182, 183, 217

[56] References Cited

U.S. PATENT DOCUMENTS

| | | | |
|---|---|---|---|
| 3,596,718 | 8/1971 | Fish et al. | 173/183 |
| 3,724,558 | 4/1973 | Rundell et al. | 173/181 |
| 3,897,834 | 8/1975 | Swopsher et al. | 173/176 |
| 4,008,773 | 2/1977 | Wallace et al. | 173/181 |
| 4,161,221 | 7/1979 | Carlin et al. | 173/176 |
| 4,403,663 | 9/1983 | Janssen . | |
| 4,609,089 | 9/1986 | Kobayashi et al. | 173/183 |
| 5,005,654 | 4/1991 | Moriki et al. | 173/183 |

FOREIGN PATENT DOCUMENTS

| | | |
|---|---|---|
| 0361634 | 2/1989 | European Pat. Off. . |
| 3801972 | 3/1989 | Germany . |
| 4128427 | 12/1992 | Germany . |
| 794045 | 4/1958 | United Kingdom . |
| 2008456 | 6/1979 | United Kingdom . |

*Primary Examiner*—Scott A. Smith
*Attorney, Agent, or Firm*—Michael J. Striker

[57] ABSTRACT

An arrangement for tightening screw connections comprises a screw spindle turnable by a screw tool, at least two-stage rotary drive for the screw spindle, the drive providing a coarse driving for pre-tightening of a screw connection and a fine driving for obtaining the desired screwing condition, a measuring value pick up for obtaining measuring values which correspond to a value of an available screwing condition, a control device for providing switching signals for the rotary drive in dependence on the measuring values determined by the measuring value pick up, the screw spindle being subdivided into at least three spindle parts, including a first spindle part connected with the drive motor for providing the coarse driving, a second spindle part, and a third spindle part, and an auxiliary drive providing the fine driving and having a drive element which together with the auxiliary drive form an independently operating structural unit which forms the second spindle part and is integrated between the first spindle part connected with the drive motor and the third spindle part carrying the mounting device, the auxiliary drive having a shaft provided with couplings for fixed connection with the first spindle part and the third spindle part, the auxiliary part further having a torque incresing transmission arranged so that the shaft is driven by the drive element through the transmission.

10 Claims, 3 Drawing Sheets

ARRANGEMENT FOR TIGHTENING SCREW CONNECTIONS

BACKGROUND OF THE INVENTION

The present invention relates to an arrangement for tightening screw connections.

Arrangements of the above mentioned general type are known in the art. Known arrangements have multi-stage rotary drive which allows a screwing-in with a high rotary speed in a first stage and tightening with a high torque in a further stage. One of such arrangements is disclosed for example in the German document DE 38 01 972 A1, in which a mechanical switching transmission is arranged after the drive motor and at a certain loading movement switches from a low torque to a high torque. A switching off device which switches off the rotary drive at reaching a predetermined screwing-in condition is however not provided. Such switching off devices are generally known and can be formed for example as mechanical overload couplings. However, there is a disadvantage here that the screwing arrangements provided with such switching off devices operate inaccurately for example due to the influence of inertia, so that the tightening moment of the screw connections tightened in this manner substantially fluctuates.

German reference DE-41 28 427 A1 discloses a power operated screwing tool which has a direct current motor operating in different working stages. In a first stage a screw connection is pre-tightened at a higher rotary speed to a predetermined screwing condition. The further tightening of the screw connection is performed then at a lower rotary speed, and the drive motor after reaching a desired screwing condition is turned off. The determination of the tightening moment is performed from the filled current taken by the motor. Screw connections can be tightened with this arrangement relatively accurately. However, the drive and the associated drive control are expensive so that such an arrangement is questionable for many applications from cost reasons.

SUMMARY OF THE INVENTION

Accordingly, it is an object of the present invention to provide a tightening arrangement for screw connections, which avoids the disadvantages of the prior art.

In keeping with these objects and with others which will become apparent hereinafter, one feature of the present invention resides, briefly stated, in an arrangement for tightening screw connections with a screw spindle, at least two-stage rotary drive for the screw spindle and including a coarse drive part and a fine drive part, a measuring value pick up for determined measuring values for screwing conditions, and a control device for producing a switching signal for the rotary drive in dependent on the screwing conditions, wherein in accordance with the present invention the screw spindle is subdivided into at least three parts and the fine drive is provided by a separate auxiliary drive part which together with a drive element forms an independently operating structural unit integrated as a second part between a first part of the screw spindle connected with the drive motor for the coarse drive and a third part of the screw spindle carrying a mounting device, and the independently operating structural unit has a shaft provided at the end sides with couplings for connection to the first part and the third part, and driveable by the drive element through a torque transmitting transmission of the auxiliary drive part.

When the arrangement is designed in accordance with the present invention, it has the advantage that without expensive driving and controlling devices a screw connection can be tightened with very high screwing accuracy with respect to a desired screwing condition. By subdividing the rotary drive into separate drive devices it is possible to provide ideally determined drive for corresponding applications. For pre-tightening of the screw connection a drive device without high accuracy with respect to the switching off moment is required. In this way any drives on the market can be utilized. By means of the auxiliary drive part integrated in the inventive arrangement the screw connection can be tightened to a predetermined screwing condition. However, for this a low rotary angle is required, so that due to the interconnected transmission also a simpler drive motor is sufficient.

The construction of the auxiliary drive as an independent structural unit ensures a component-like assembly of the arrangement from individual components in accordance with a modular principle. Therefore a construction of the arrangement corresponding to the respective requirements and a simple mounting and dismounting of individual components is easily possible. An expensive universal drive with expensive power part is not needed.

In accordance with further features of the present invention the auxiliary drive part can be switched on and off in dependence on the screwing condition by the control device. It can be also driveable by an electric motor through a drive pinion or by a pneumatic cylinder-piston unit coupled with a toothed rack.

The measuring value pick up can be formed as a sensor located between the auxiliary drive and the mounting device and producing electrical signals for the control device.

The transmission can be provided with a drive gear arranged on the shaft and coupled with the shaft through a free running element which blocks in a circumferential direction of the drive gear so that during tightening of the screw connection a torque can be transmitted from the drive gear to the shaft and not vice versa from the shaft to the drive gear.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
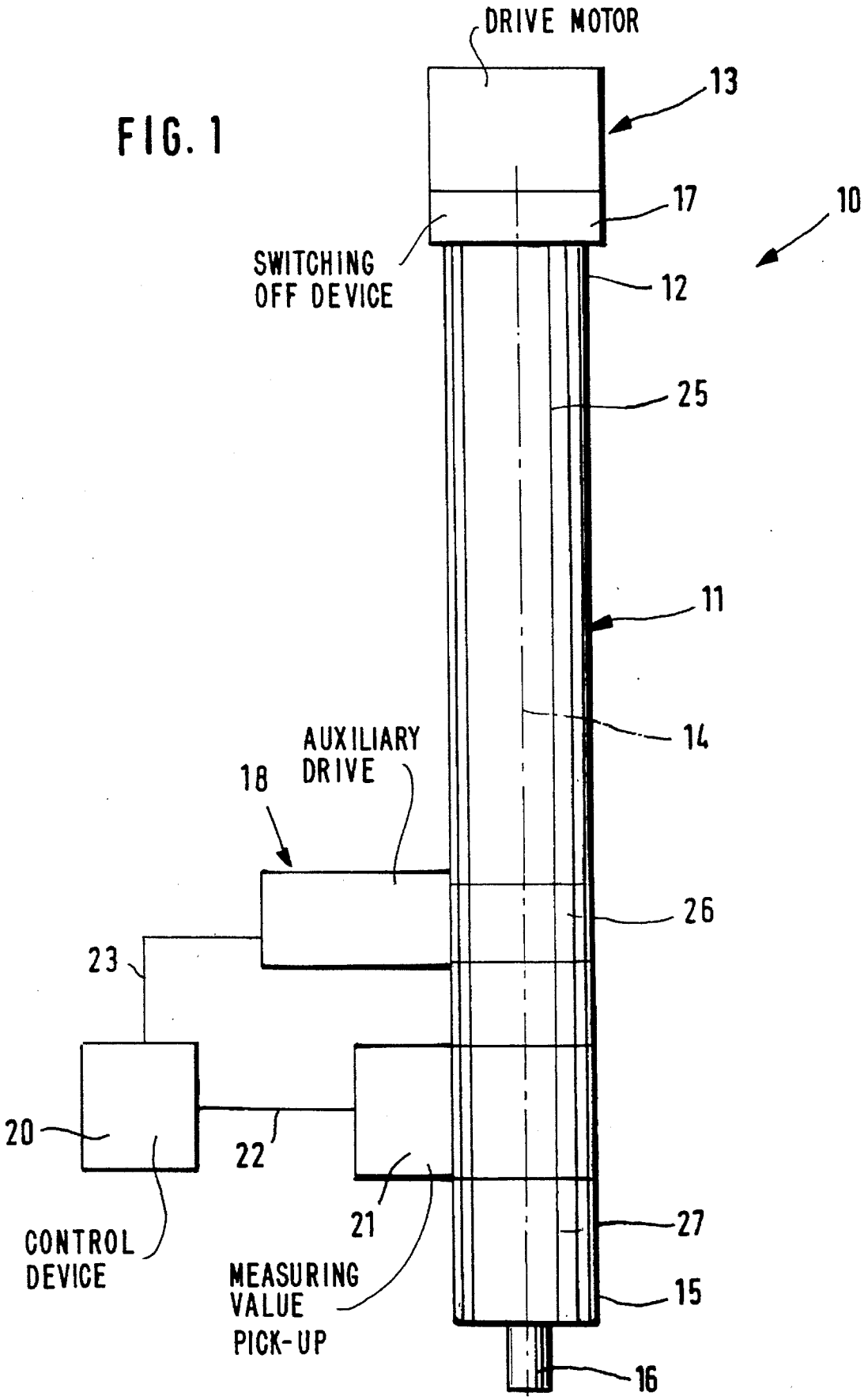
FIG. 1 is a view schematically showing an arrangement for tightening screw connections in accordance with the present invention.

An arrangement for tightening screw connections is shown schematically in FIG. 1. The arrangement is identified with reference numeral 10 and has a screw spindle 11 coupled at its end 12 with a drive motor 13. The screw spindle 11 is rotatably driveable about its longitudinal axis 14 by the drive motor 13. At its end 15 facing away from the drive motor 13, the screw spindle 11 carries a known device 16 for mounting any screwing tool, for example a screw bit.

A switching off device 17 is located between the drive motor 13 and the screw spindle 11. When a predetermined screwing torque acting on the screw spindle 11 is reached, it provides switching off. The switching off device can be formed for example as a known overloading coupling which automatically uncouples at a predetermined torque. The switching off device 17 and the drive motor 13 can be formed as a joint structural joint as shown in FIG. 1.

It is also possible to use other measuring values then the screwing torque for example the covered rotary angle or the number of revolutions of the screw spindle 11 as a criterium for the switching off of the drive motor 13 by the switching off device 17. The drive motor 13 is used however only for pre-tightening of the screw connection. For the subsequently required tightening to a desired screwing condition, an auxiliary drive 18 is provided. The auxiliary drive 18 together with a drive element is arranged as an independently operating structural unit between the mounting device 16 and the drive motor 13.

The drives 13, 18 are formed in accordance with corresponding applications. While during pre-tightening a relatively high spindle rotary speed is required with a low torque, during final tightening to a predetermined torque a slow rotation with a high torque is required. Due to the separation of the driving structure into separate drives, simple well known drives can be utilized. Expensive universal drives for example NC motors are not needed.

Figure 2:
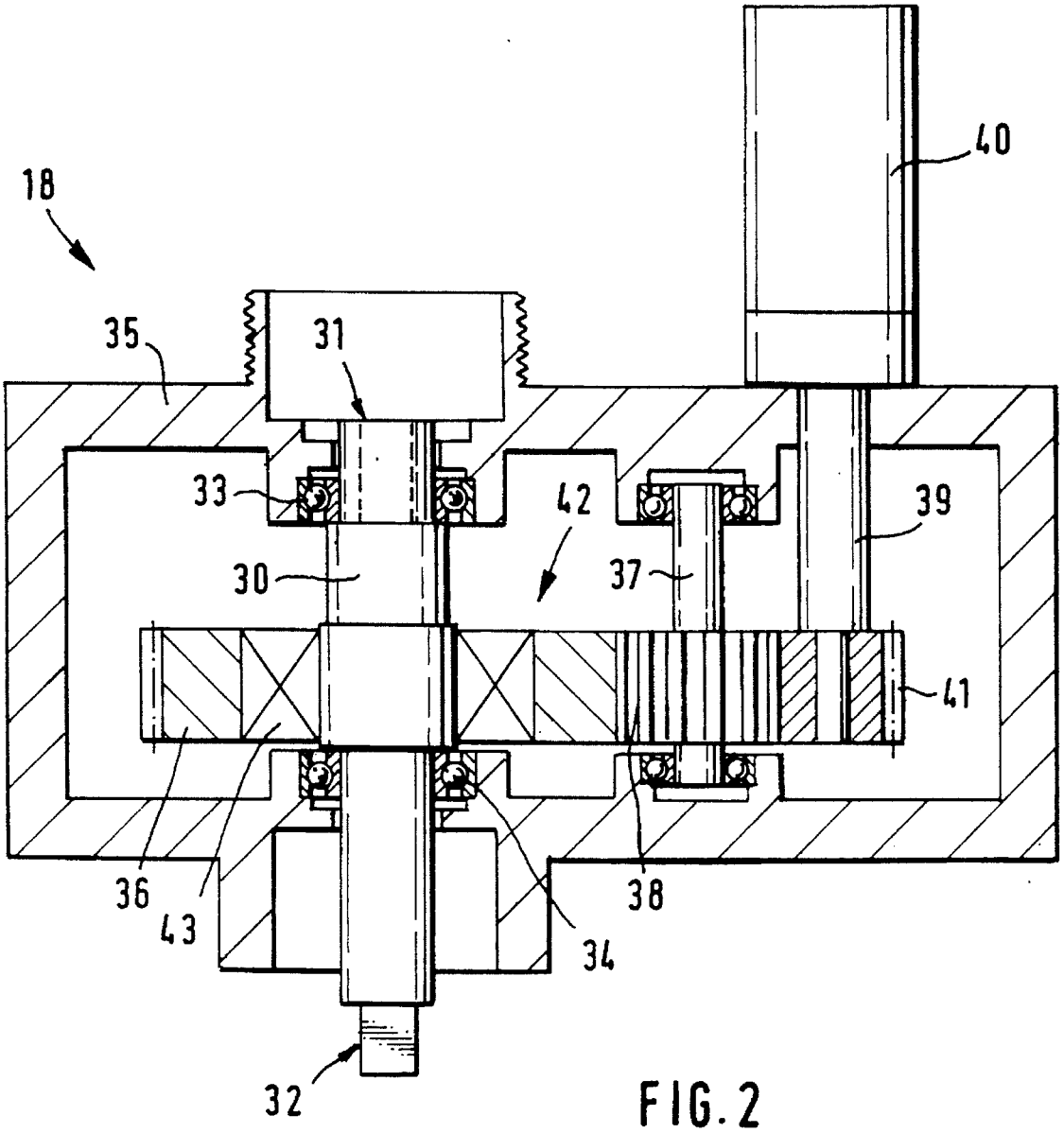
FIG. 2 is a view showing a longitudinal section through a first embodiment of an auxiliary drive of the inventive arrangement.
Figure 3:
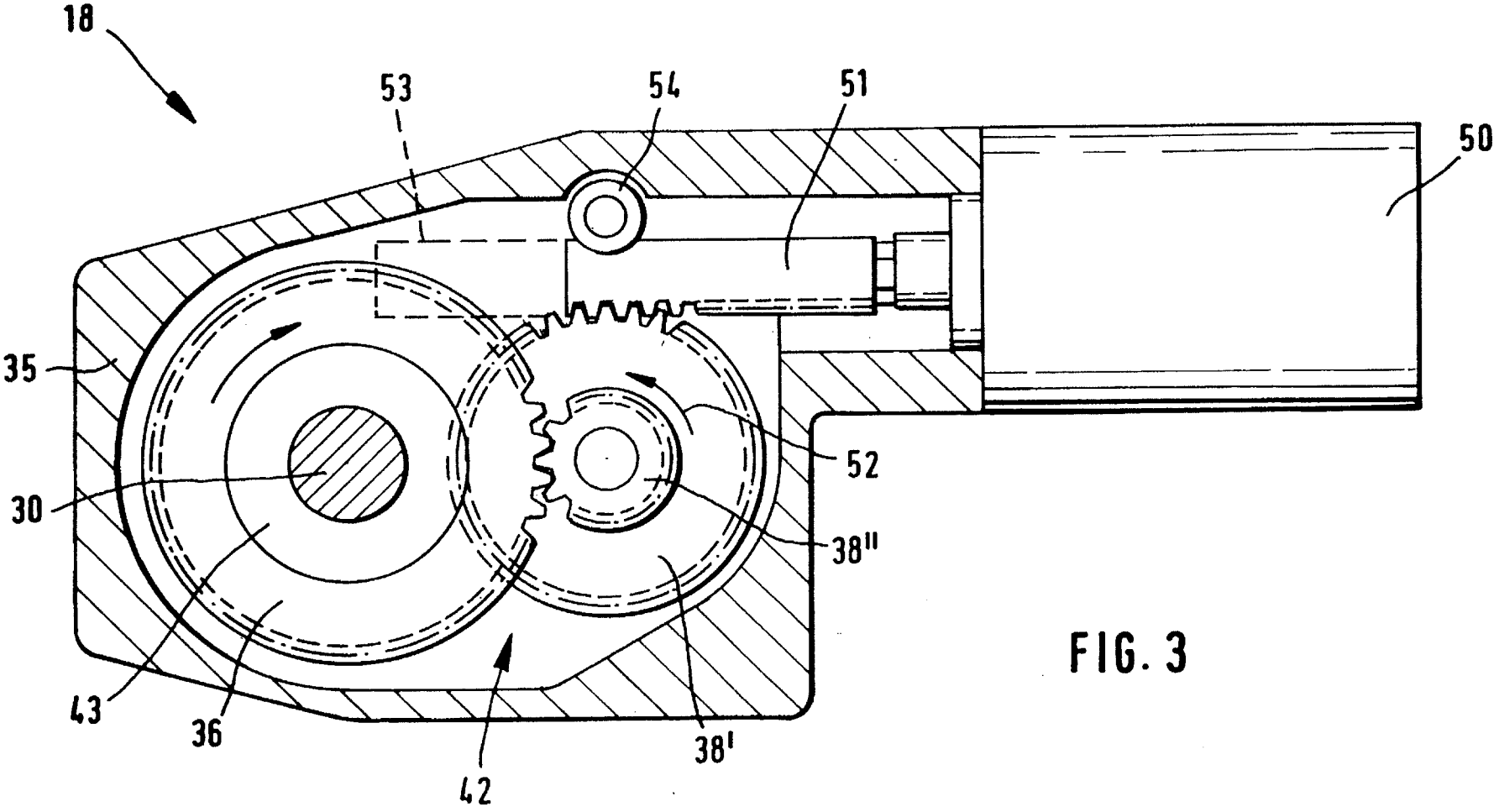
FIG. 3 is a view showing a transverse section through a second embodiment of the auxiliary drive.

The auxiliary drive 18 shown in FIGS. 2 and 3 is switchable on and off by a known control device 20. The control device 20 receives signals corresponding to the value of the actual screwing condition from a measuring value pick up 21 which for example senses the portion moment and/or rotary angle of the screw spindle 11 acting in the screw spindle. Known sensors for example strain gauges, eddy current measuring value transducers, rotary angle transducers, etc. can be used as the measuring value pick up 21. For receiving the measuring values they are arranged on the screw spindle 11 or integrated in the latter. The measuring value pick up 21, the control device 20 and the auxiliary drive 18 are connected by conductors 22 and 23 for transmitting corresponding signals.

In the shown embodiment the screw spindle 11 is composed of three parts. The first part 25 carries the drive motor 13 and connects the latter with a second part 26 which has the auxiliary drive 18, and a third part 27 connects the auxiliary drive 18 with the mounting device 16. In this way an individual assembly of the arrangement 10 is possible in accordance with the modular principle. The measuring value pick up 21 is provided for example on the third part 27 of the screw spindle 11. The measuring value pick up 21 can be formed as an independent structural unit and arranged exchangeably as a further part of the screw spindle 11 between the auxiliary drive 18 and the third part 27.

FIG. 2 shows the construction of the auxiliary drive 18. The auxiliary drive 18 has a shaft 30 which forms the second part 26 of the screw spindle 11. The shaft 30 has a first coupling device 31 for connection with the first part 25 of the screw spindle 11 and a second coupling device 32 for connection to the third part 27 of the screw spindle 11. The shaft 30 is supported by roller bearings 33 and 34 in a housing 35 of the auxiliary drive 18 rotatably about a longitudinal axis 14 shown in FIG. 1. The shaft 30 carries a drive gear 36 which engages with an intermediate gear 38 arranged on an intermediate shaft 37. The intermediate shaft 37 is in turn driveable by a drive pinion 41 arranged on a motor shaft 39 of an electric motor 40. The gears 36 and 38 have different partial circle diameters and form a torque-increasing transmission 42 in direction from the electric motor 40 to the shaft 30.

The drive gear 36 is coupled with the shaft 30 through a known free running element 43. The free running element 43 operates so that in the tightening direction of the screw spindle 11 a torque is transmitted from the gear 36 to the shaft 30 but not in an opposite direction from the shaft 30 to the drive gear 36. The transmission 42 is uncoupled during the pre-tightening by the drive motor 13 of FIG. 1. The locking of the free running element 43 can be also switchable, so that when needed a rotary reverse of the screw spindle 11 is possible in a simple manner.

FIG. 3 shows a second embodiment of an auxiliary drive 18 which differs from the first embodiment of FIG. 2 by a different drive and a different transmission. Instead of the electric motor 40 with the drive pinion 41 arranged on the motor shaft 39, a pneumatic cylinder-piston unit 50 acting on a toothed rack 51 is utilized here. The parts of this embodiment which are the same or similar to the embodiment of FIG. 2 are identified with the same reference numerals.

The toothed rack 51 engages with the first intermediate gear 38' which during a displacement of the toothed rack 51 is turned in direction of an arrow 52 and actuates a corresponding pe-rotary movement of the intermediate shaft 37. A second intermediate gear 38" is axially offset relative to the first intermediate gear 38' and fixedly connected with the intermediate shaft 37 as well. The second intermediate gear 38" engages with the drive gear 36 which is rotatable in an opposite direction. The partial circle diameters of the gear 38', 38" and 36 are selected so that they form a torque-increasing transmission 42 in direction toward the shaft 30. Due to the offset arrangement of the intermediate gears 38', 38", an increased stroke of the pneumatic cylinder-piston unit 50 to the end position 53 identified in a broken line is guaranteed.

The free running element 43 provided between the shaft 30 and the drive gear 36 uncouples the transmission 42 from the shaft 30 and allows after the obtained tightening of the screw connection, the return of the toothed rack 51 to the initial position of the toothed rack or the pneumatic cylinder-piston unit 50 shown in FIG. 3 in solid lines, without transmitting the return movement to the shaft 30. The pneumatic cylinder-piston unit is switchable by known switching elements, for example a magnetic valve, so as to switch the direction of torque transmission to an opposite one. The toothed rack 51 can be additionally guided relative to the housing 35 by a supporting roll 54.

It will be understood that each of the elements described above, or two or more together, may also find a useful application in other types of constructions differing from the types described above.

While the invention has been illustrated and described as embodied in an arrangement for tightening screw connections, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for tightening screw connections, comprising a screw spindle for turning a screwing tool; at least two-stage rotary drive for said screw spindle, said drive providing a coarse driving for pre-tightening of a screw connection and a fine driving for obtaining the desired screwing condition; a measuring value pick up for obtaining measuring values which correspond to a value of an available screwing condition; a control device for providing switching signals for said rotary drive in dependence on the measuring values determined by said measuring value pick up, said screw spindle being subdivided into at least three spindle parts, including a first spindle part connected with said drive for providing the coarse driving, a second spindle part, and a third spindle part engageable with the screwing tool; an auxiliary drive providing the fine driving, said auxiliary drive meshing with said second spindle part and being integrated between said first spindle part connected with said drive and said third spindle part, said second spindle part being a shaft provided with couplings for fixed connection with said first spindle part and said third spindle part, said auxiliary drive further having a torque increasing transmission arranged so that said shaft is driven by said drive element through said transmission.

2. An arrangement as defined in claim 1; and further comprising a mounting device cooperating with the screwing tool and arranged on said third spindle part.

3. An arrangement as defined in claim 2, wherein said measuring value pick up is arranged between said auxiliary drive and said mounting device.

4. An arrangement as defined in claim 3, wherein said measuring value pick up is formed as a sensor arranged between said auxiliary drive and said mounting device and supplying electric signals to said control device.

5. An arrangement as defined in claim 1, wherein said control device is formed so as to turn on and off said auxiliary drive in dependence on a screwing condition.

6. An arrangement as defined in claim 1, wherein said auxiliary drive has an electric motor and a drive pinion through which said electric motor drives said shaft of said auxiliary drive.

7. An arrangement as defined in claim 1, wherein said auxiliary drive has a pneumatic cylinder-piston unit and a toothed rack through which said pneumatic cylinder-piston unit drives said shaft.

8. An arrangement as defined in claim 1, wherein said transmission has a drive gear arranged on said shaft and a free running element which couples said drive gear with said shaft in one circumferential direction of said gear so that during tightening a screw connection a torque is transmitted from said drive gear to said shaft and not transmitted in an opposite circumferential direction from said shaft to said drive gear.

9. An arrangement as defined in claim 8, wherein said transmission is formed as a gear transmission.

10. An arrangement as defined in claim 8, wherein said free running element has a switchable direction, so as to switch a direction of transmission of the torque to an opposite one and to thereby transmit the torque from said shaft to said drive gear and not transmit the torque from said drive gear to said shaft.

* * * * *